United States Patent [19]

White

[11] 4,135,648

[45] Jan. 23, 1979

[54] METERING VALVE FOR PRESSURIZED DISPENSING CONTAINERS

[75] Inventor: Barry F. White, Merrimack, N.H.

[73] Assignee: Summit Packaging Systems, Inc., Manchester, N.H.

[21] Appl. No.: 845,646

[22] Filed: Oct. 26, 1977

[51] Int. Cl.[2] ..... B65D 83/14; G01F 11/28

[52] U.S. Cl. ..... 222/402.20

[58] Field of Search ..... 222/402.20, 450; 137/843; 138/43

[56] References Cited

U.S. PATENT DOCUMENTS

| | | | |
|---|---|---|---|
| 2,932,432 | 4/1960 | Beard | 222/402.2 |
| 3,130,880 | 4/1964 | Briechle | 222/402.2 |
| 3,158,298 | 11/1964 | Briechle | 222/402.16 |

*Primary Examiner*—John P. Shannon

*Attorney, Agent, or Firm*—Dallett Hoopes

[57] ABSTRACT

Metering valve employs resilient ball to block inlet while outlet port is open. Inlet seat includes projections which assure unseating of the ball when the valve actuator is released.

2 Claims, 5 Drawing Figures

METERING VALVE FOR PRESSURIZED DISPENSING CONTAINERS

BACKGROUND OF THE INVENTION

1. Field of the Invention

This invention relates to metering valves for pressurized dispensing containers. More particularly, the invention relates to valves for aerosol containers the contents of which are to be dispensed in a metered fashion so that only a limited amount of product is dispensed at one actuation of the valve.

2. Description of the Prior Art

The prior art, of course, is replete with illustrations of metering dispensing valves for pressurized aerosol containers. A large number of such valves involve the use of a plunger, the lower end of which is adapted to block the inlet to the valve housing when the plunger is depressed so that no further product is permitted to enter the housing and only the product already in the housing at the commencement of the actuation is dispensed.

Other prior art discloses the concept of using an object such as a metal ball, as in the case of Howell U.S. Pat. No. 2,693,983, granted Nov. 6, 1954, to close off the housing inlet during dispensing. An additional disclosure in which a resilient ball is used is in the Beard U.S. Pat. No. 2,932,432 which issued Apr. 12, 1960.

In the latter patent, embodiments are disclosed which utilize a resilient ball, and dispose the housing inlet at a position offset from the centerline of the housing. This was done presumably to assure that when the actuation was concluded and the plunger permitted to rise, the ball would not remain seated, blocking the housing inlet.

The earlier patent contemplates the closing of the inlet by having the plunger squash out the resilient ball so that its circumference engages the walls of the housing above the actual housing inlet. Apparently, the concept of seating the resilient ball on an annular seat immediately surrounding the housing inlet was not hit upon in the prior art because of the supposed difficulty in assuring that the ball would unseat once the plunger was released and permitted to travel up.

SUMMARY OF THE INVENTION

Under the present invention and as in the above-identified Beard patent, a resilient ball is used to block off the housing inlet in an aerosol dispensing valve. However, as an improvement over the prior art, the ball of the present invention seats simply on an axial housing inlet seat. Such an inlet makes the housing easier to produce and work with than offset inlets. Under the present invention, the unseating of the valve, once the plunger is released, is assured by virtue of the special structure of the seat. This structure involves the use of a plurality of inward projections level with the seat and spaced about the circumference of the inlet, the projections normally supporting the ball off the seat to thereby preclude the seating of the ball except when it is engaged by said plunger.

Other objects and features of the invention will be apparent from a reading of the following specification and a study of the annexed drawings, all of which disclose a non-limiting form of the invention. In the drawings:

FIG. 5 is taken on the line 5—5 of FIG. 4.

DESCRIPTION OF THE PREFERRED EMBODIMENT

Figure 1:
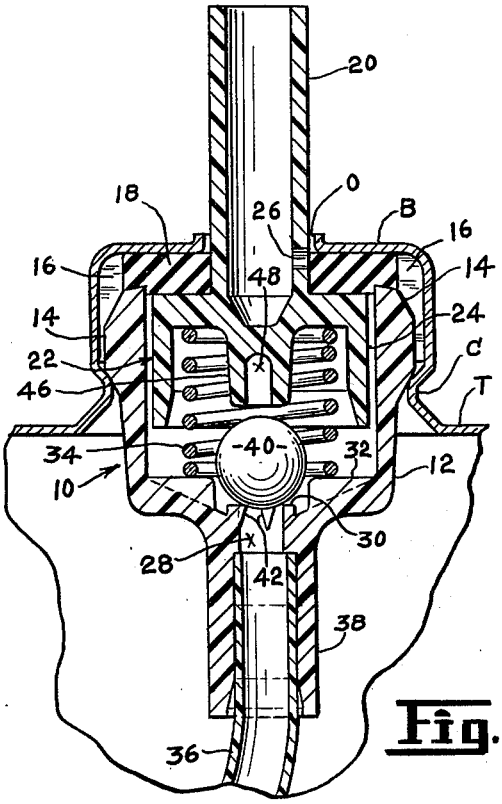
FIG. 1 is a sectional view of a valve embodying the invention installed in the top of an aerosol container.

Referring more specifically to the drawings, the top wall of an aerosol container is designated T in FIG. 1 and is formed with an upward stamped boss B having a central opening O. The boss is crimped in at C to hold in place the upper enlarged end of an aerosol metering valve 10.

The valve comprises the housing 12 including sidewalls having an upper annular enlargement 14 featuring castellations 16 thereabout. Disposed inside the castellations and sitting on top of the wall 14 is the annular gasket 18. This structure, including castellations and gasket 18, is as shown in the U.S. Pat. No. 3,158,298 which issued Nov. 24, 1967 to Briechle. The purpose of the castellations and gasket which normally fits against the top wall of the boss B is to permit fast filling, as will be understood from the Briechle patent, and to provide a check valve to preclude escape of pressure from the container other than through the dispensing valve.

Figure 2:
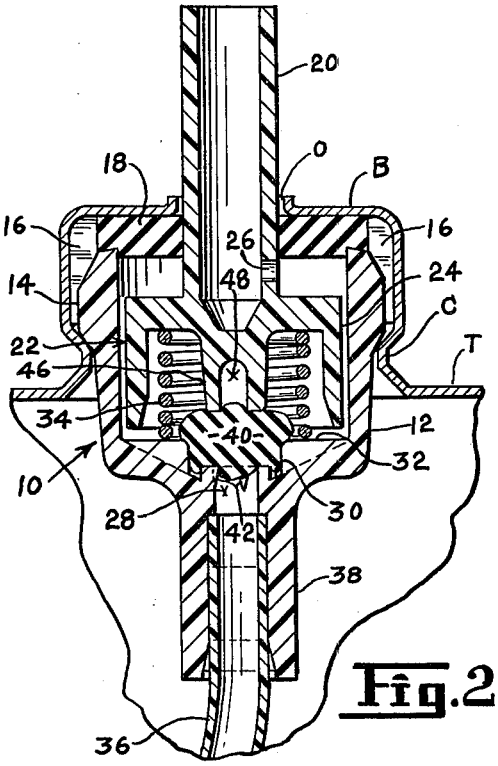
FIG. 2 shows the valve of FIG. 1 in depressed condition.
Figure 3:
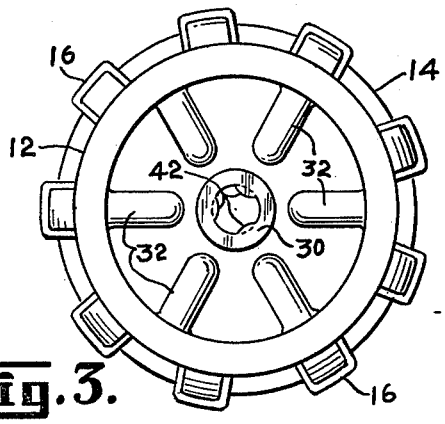
FIG. 3 is a view downward of a valve housing embodying the invention and enlarged with respect to FIGS. 1 and 2.

Sealingly disposed in the opening in the gasket 18 and extending through the opening O in the boss is the stem 20 of the plunger 22. The plunger includes a head portion 24 which has a downward annular flange closely spaced from the inner surface of the sidewall of the housing 12. As shown, the stem is formed with a discharge port 26 which normally aligns with the top of the gasket 18 precluding discharge. During dispensing, when the plunger is depressed, the discharge port 26 (FIG. 2) lowers to below the level of the gasket 18 and permits discharge.

As shown, the lower wall of the housing 12 is funnel-shaped (FIG. 1) and formed with an axial inlet passage 28, the upper end of which extends above the adjacent surface of the lower wall of the housing to provide a raised seat 30. Surrounding the seat are a plurality of upstanding radial fins 32 integrally formed with the housing. As is conventional, an axial spring 34 urges the plunger upward. The spring is disposed compressively between the underside of the plunger 22 and the top of the fins 32.

A dip tube 36 extends to the lower portion of the container (not shown) and its upper end is press-fitted into the inlet opening of the tailpiece 38.

Figure 4:
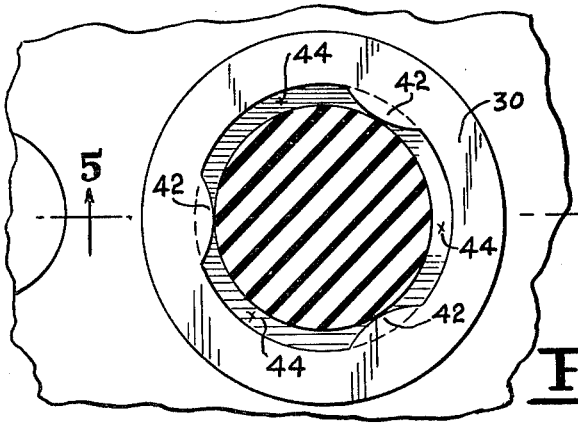
FIG. 4 is a sectional view taken on the line 4—4 of FIG. 5.
Figure 5:
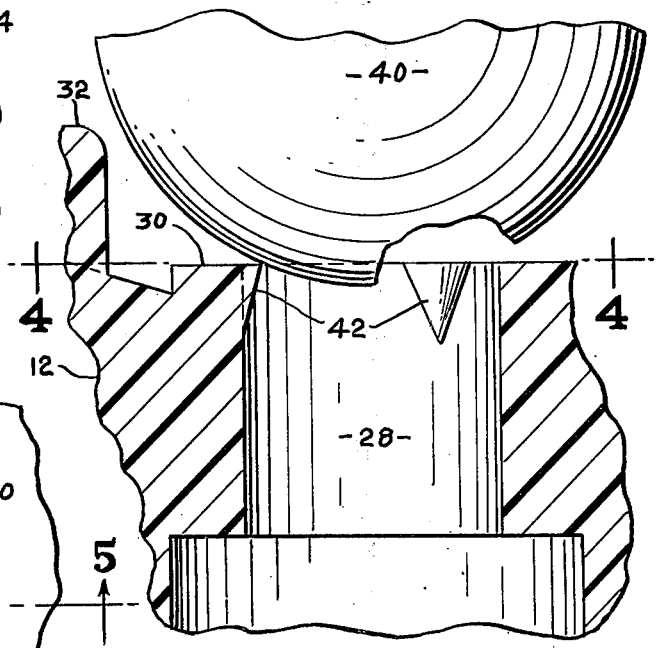
FIG. 5 is a fragmentary, sectional view, enlarged with respect to FIGS. 1 through 3, showing the ball disposed on the inlet seat once the plunger has been released.

Focusing now on the lower valve means for the metering valve of the invention, there is provided a resilient ball 40 which is normally disposed above the seat 30. As best shown in FIG. 5, the inlet opening central of the seat 30 is formed with a plurality of inward inverted conical projections 42, the upper ends of which are level with the top of the seat 30. As shown, the ball 40, kept generally in position by the fins 32, normally sits on the innermost portions of the projections 42 (FIG. 4). This provides a plurality of arcuate gaps 44 assuring ready communication between the inlet and the interior of the housing.

Means to depress the ball comprises a downward spud 46 integral with the plunger and disposed axially thereof. The spud, as shown, may have an axial recess 48 which makes it easier to mold.

The operation of the valve of the invention will now be apparent. Normally (FIG. 1), the vapor pressure in the container drives the product/propellant liquid up the dip tube 36 through the arcuate gaps 44 (FIG. 4) inbetween bore 40 and seat 30 and into the chamber of the valve housing 12.

When the valve is actuated by the depression of the stem (usually provided with an actuator button, not shown), the plunger 22 is depressed so that the discharge port 26 end (FIG. 2) clears the bottom of the gasket 18 and permits discharge of product through the stem 20. At about the level of valve depression at which the port 28 clears gasket 18, the spud 46 engages the ball 40 and begins to compress it. Compression of the ball 40 (FIG. 2) results in the distortion thereof so that the lower surface of the valve sits tightly against the annular seat 30. This, of course, closes off further entry of product/propellant liquid from inlet 28 into the housing 12.

When all of the liquid in the chamber inside the housing 12 has moved out through passage 26 and an equilibrium with atmosphere results, there is no further dispensing. The metered quantity has been dispensed.

Subsequently, the stem 20 is permitted to rise as the actuator button is released. This causes the closing of the discharge port 26 as it moves up and is eclipsed by the gasket 18. Almost simultaneously, the ball 40, released from its condition of distortion by the raising of the spud 46, is urged upward to the position shown in FIG. 1 by the resilience of the ball acted on by the projections 42. These projections assure that the ball 40 unseats from its annular seat 30 and once again permits entry into the chamber inside housing 12 of product/-propellant liquid ready for the next discharge.

Preferably, the diameter of the ball 40 and the proportions of the other parts permit the engagement of the spud 46 with the ball almost simultaneously with the opening of the discharge port 26. This assures that there is minimum likelihood of the plunger being partly depressed to a condition at which there is uncontrolled flow-through caused by both the port 26 and gaps 44 being opened. Thus, the ball 40 has a diameter not exceeding the distance from the inner end of spud 46 to the seat but sufficiently great such that any axial play between the plunger and the ball in the normal outer position of the plunger is less than the distance the plunger must be depressed to bring port 26 down to the level of the underside of gasket 18.

In an actual embodiment, the end housing of the valve is a condensation polymer such as Nylon, and the plunger is of an acetal, such as Delrin. The ball is of Buna-N having resilience of 55 durometer. The gasket is also of Buna-N.

It will be clear from the above discussion that the present disclosure offers a metering valve which is easy to produce and foolproof in operation. Part of the reliability of the valve is attributable to the special cooperation between the resilient ball disclosed and the specially shaped inlet seat with projections.

Clearly, the amount of the metered volume may be changed by altering the height and therefore volume of the housing 12. Corresponding changes to the length of spud 46 will then be necessary, as described.

It should be understood that while the invention has been disclosed in only one form, it is not so limited but may be defined by the following claim language and equivalents:

I claim:

1. A dispensing valve for releasing measured amounts of pressurized fluid from a storage container upon each actuation of the valve, comprising a valve housing having a fluid inlet and a fluid outlet at respectively opposite ends and a metering chamber intermediate said ends, an annular sealing gasket carried by said housing at its outlet end and a reciprocable plunger passing through said gasket forming a sliding seal therewith, said plunger extending into said chamber in peripherally spaced relation to the side walls thereof, spring means engaging said plunger and urging it normally outwardly of said chamber, said plunger having a peripheral enlargement intermediate its longitudinal extent engaging with the inner margin of said annular gasket within said chamber in the outer position of said plunger, a fluid passage in said plunger open to atmosphere at its outer end and a restrictive discharge port in the side of said plunger and communicating with said passage above said enlargement, said discharge port being normally disposed outside said metering chamber but moved thereinto when said plunger is depressed, said valve housing having an annular valve seat at its inlet end the seat being formed with an axially disposed inlet opening, said valve seat being spaced from the inner end of said plunger when the latter is in its normal outer position a distance greater than the axial distance said plunger must be depressed to bring said plunger port into communication with said metering chamber, and a spherical resilient compressible valve member disposed within said chamber between said seat and the inner end of said plunger, said valve member being slightly larger in diameter than the diameter of said valve seat, said valve member having a diameter not exceeding the distance from the inner end of said plunger to said seat but sufficiently great such that any axial play between the plunger and the valve member, in the normal outer position of said plunger, is less than the distance said plunger must be depressed to bring its discharge port into communication with said metering chamber, the valve seat opening being shaped with inward projections spaced about its circumference normally to thereby support the valve member off the seat and preclude the undesired seating of the valve except when it is engaged by said plunger.

2. A dispensing valve as claimed in claim 1 wherein the projections are in the shape of a segment of an inverted cone and the upper ends of the projections are level with the top surface of the seat.

* * * * *